US009047854B1

(12) United States Patent
Kosmer

(10) Patent No.: US 9,047,854 B1
(45) Date of Patent: Jun. 2, 2015

(54) APPARATUS AND METHOD FOR THE CONTINUOUS OPERATION OF MUSICAL INSTRUMENTS

(71) Applicant: TopLine Concepts LLC, Abingdon, MD (US)

(72) Inventor: Adam R. Kosmer, Abingdon, MD (US)

(73) Assignee: Topline Concepts, LLC, Abingdon, MD (US)

( * ) Notice: Subject to any disclaimer, the term of this patent is extended or adjusted under 35 U.S.C. 154(b) by 0 days.

(21) Appl. No.: 14/212,736

(22) Filed: Mar. 14, 2014

(51) Int. Cl.
*G10H 1/18* (2006.01)
*G10H 1/00* (2006.01)

(52) U.S. Cl.
CPC ..... *G10H 1/18* (2013.01); *G10H 1/0016* (2013.01)

(58) Field of Classification Search
USPC ..... 84/615, 653, 477 R, 478, 479 A
IPC ..... G10H 1/18
See application file for complete search history.

(56) References Cited

U.S. PATENT DOCUMENTS

| | | | | | |
|---|---|---|---|---|---|
| 2,517,026 | A * | 8/1950 | Quednau | 84/478 |
| 2,814,230 | A * | 11/1957 | Johnston | 84/478 |
| 2,958,251 | A * | 11/1960 | Calabro | 84/477 R |
| 3,001,435 | A * | 9/1961 | Duffy et al. | 84/474 |
| 3,185,016 | A * | 5/1965 | Stinson, Jr. et al. | 84/478 |
| 3,403,589 | A * | 10/1968 | Fried | 84/478 |
| 3,426,639 | A * | 2/1969 | Maxwell | 84/330 |
| 3,581,618 | A * | 6/1971 | Perrault | 84/477 R |
| 3,626,802 | A * | 12/1971 | Halpin | 84/478 |
| 3,651,731 | A | 3/1972 | Congost | |
| 4,144,791 | A | 3/1979 | Veach | |
| 6,153,822 | A | 11/2000 | Toba et al. | |
| 6,291,749 | B1 | 9/2001 | Tseng | |
| 6,331,668 | B1 * | 12/2001 | Michero | 84/477 R |
| 6,960,711 | B2 | 11/2005 | Huang | |
| 7,544,870 | B2 | 6/2009 | White | |
| 7,642,730 | B2 | 1/2010 | Dowling et al. | |
| 7,692,086 | B2 * | 4/2010 | Nease et al. | 84/485 R |
| 7,750,224 | B1 * | 7/2010 | Rav-Niv et al. | 84/483.1 |
| 2005/0108357 | A1 * | 5/2005 | Sano | 709/217 |
| 2006/0225561 | A1 * | 10/2006 | Kobayashi et al. | 84/604 |
| 2007/0282467 | A1 * | 12/2007 | Rodrigues et al. | 700/83 |
| 2008/0190271 | A1 * | 8/2008 | Taub et al. | 84/645 |
| 2008/0250914 | A1 * | 10/2008 | Reinhart et al. | 84/645 |
| 2008/0271592 | A1 * | 11/2008 | Beckford | 84/645 |
| 2008/0307945 | A1 * | 12/2008 | Gatzsche et al. | 84/477 R |

(Continued)

*Primary Examiner* — David Warren
(74) *Attorney, Agent, or Firm* — Larry J. Guffey; Oliver & Grimsley, LLC

(57) ABSTRACT

An apparatus, that allows one to control the operation of a musical instrument, includes: a rotatably mounted, circular cylinder having on its outer surface rings of individual lights, a photosensor associated with each ring of lights that yields an output signal that controls the operation of the musical instrument's strikers, a rotation sensor that provides a rotation output signal indicative of the cylinder's rotational position, a programmable controller with a memory storage element, a means for inputting into the memory storage element a music input signal having the information necessary to cause the acoustical members of the musical instrument to play a desired musical composition, and a software program that uses the music input and rotation output signals to generate a control signal for the light's power source that intermittently illuminates the rings of lights so that the photosensors output signals cause the strikers to create those sounds required to play the desired musical composition.

20 Claims, 10 Drawing Sheets

(56) References Cited

U.S. PATENT DOCUMENTS

| | | | | |
|---|---|---|---|---|
| 2009/0216354 | A1* | 8/2009 | Ong et al. | 700/94 |
| 2010/0313736 | A1* | 12/2010 | Lenz | 84/477 R |
| 2011/0011243 | A1* | 1/2011 | Homburg | 84/612 |
| 2011/0011245 | A1* | 1/2011 | Adam et al. | 84/612 |
| 2011/0011246 | A1* | 1/2011 | Buskies et al. | 84/613 |
| 2011/0015767 | A1* | 1/2011 | Homburg et al. | 700/94 |
| 2011/0041672 | A1* | 2/2011 | Chan et al. | 84/645 |
| 2011/0175915 | A1* | 7/2011 | Gehring | 345/440 |
| 2011/0247479 | A1* | 10/2011 | Helms et al. | 84/613 |
| 2011/0247480 | A1* | 10/2011 | Gehring et al. | 84/613 |
| 2011/0259176 | A1* | 10/2011 | Pillhofer et al. | 84/470 R |
| 2011/0307084 | A1* | 12/2011 | Gehring et al. | 700/94 |
| 2012/0050176 | A1* | 3/2012 | Chin | 345/173 |
| 2012/0220187 | A1* | 8/2012 | Hillis et al. | 446/297 |
| 2012/0255424 | A1* | 10/2012 | Matsumoto | 84/611 |
| 2012/0297957 | A1* | 11/2012 | Lewison et al. | 84/478 |
| 2013/0053993 | A1* | 2/2013 | Setoguchi | 700/94 |
| 2013/0182856 | A1* | 7/2013 | Setoguchi | 381/56 |
| 2013/0305906 | A1* | 11/2013 | Kinter | 84/613 |
| 2014/0053711 | A1* | 2/2014 | Serletic et al. | 84/611 |
| 2014/0140536 | A1* | 5/2014 | Serletic et al. | 381/98 |
| 2014/0251116 | A1* | 9/2014 | Peterson | 84/645 |
| 2014/0254834 | A1* | 9/2014 | Umeo | 381/119 |
| 2014/0270263 | A1* | 9/2014 | Fejzo et al. | 381/119 |
| 2014/0301573 | A1* | 10/2014 | Kiely et al. | 381/119 |

* cited by examiner

APPARATUS AND METHOD FOR THE CONTINUOUS OPERATION OF MUSICAL INSTRUMENTS

BACKGROUND OF THE INVENTION

1. Field of the Invention

The present invention generally relates to automatic musical instruments. More specifically, the present invention relates to the operation of musical instruments that perform in a manner similar to a conventional music box.

2. Description of the Related Art

Various apparatus for operating musical instruments and thereby enabling them to perform musical fragments, by way of percussion and/or vibration effects, are well known in the art. See, for example, U.S. Pat. Nos. 3,651,731, 6,153,822, 7,642,730, 6,291,749, 4,144,791, 6,960,711 and 7,544,870.

The earliest examples of such an apparatus usually had a rotary cylinder or barrel that is fitted with pegs or similar members which, directly or through some other mechanism, acted upon sound devices, such as slats, strings, tongues or others of similar nature. In certain cases, as occurs with music boxes, the above-mentioned pegs are fixed and it is not feasible to change their position at will in order to vary the musical composition.

Traditionally, music boxes have been limited by the size of the cylindrical shaped body or barrel upon which the music itself can be represented. Upon activation, only the music described by the physical representation of the barrel can be expressed, and nothing more. Upon one single revolution of the cylindrical body, the music repeats itself, thus limiting the musical composition reproduction to a fraction of a complete piece. This is an extreme limitation that, if it could be overcome, would greatly extend the useful range of music boxes.

An improvement on this range limitation of the traditional music box has been the addition of user-removable pegs. This improvement allowed for changing the barrel music to suit the user, but the resulting improved music boxes are still limited by the temporal duration of the music that can be mechanically fitted onto a barrel and played in a single revolution of the barrel or cylinder.

Player pianos and their modern counterpart, the reproducing piano, are another type of automated musical instrument intended to perform musical compositions independently—i.e., without real-time, human interaction or input. Typically, the apparatus for these instruments use perforated metal discs or barrels, paper piano rolls, or, in the case of the modern reproducing piano, MIDI computer connections and/or digital CD-ROM interfaces which drive the piano through pneumatic or electronic means to reproduce musical compositions automatically.

While pianos utilizing these technologies are typically capable of reproducing full or nearly full compositions without much real-time, human interaction, they do have limitations. For example, such instruments when playing do not provide those in the vicinity of them with the visual stimulation provided by a music box's standard rotating cylinder or barrel.

Thus, there continues to exist a need for an apparatus that can better automate the playing of certain types of musical instruments so as to enable them to play a longer temporal duration of, or a greater percentage of, a musical composition than that which can be mechanically fitted onto a rotating cylinder or barrel and played in a single revolution of the barrel.

SUMMARY OF THE INVENTION

Recognizing the need for an improvement to an automated musical instrument, of the type that creates music by way of percussion and/or vibration effects—such as a music box, that will allow for a greater percentage of a musical composition to be played than that which can be mechanically fitted onto the music box's barrel and played in a single revolution of the barrel, the present invention is generally directed to providing such an improved, automated musical instrument.

A preferred embodiment of the present invention is an apparatus that allows one to control the operation of a musical instrument of the type that includes a plurality of acoustical members and strikers, wherein each of these strikers is configured to actuate the creation of sound from one of the acoustical members. This embodiment includes: (a) a rotatably mounted, circular cylinder, (b) a plurality of rings of individual, spaced-apart lights that are located on the cylinder's outer surface, (c) a plurality of photosensors, each of which has a field of view and a configuration adapted to: ($c_1$) orient the field of view of the photosensor towards a point through which passes the path of one of the rings of lights as the cylinder is rotated about its axial centerline, and ($c_2$) yield a photosensor output signal that is capable of controlling the temporal operation of one of the strikers, (d) a rotation sensor having a configuration adapted to detect the rotational position of the cylinder's outer surface and to generate a rotation output signal that is indicative of this rotational position, (e) a power source having a configuration adapted to supply the power necessary to illuminate the rings of lights, (f) a programmable controller with a cooperating memory storage element, (g) a means for inputting into the memory storage element a music input signal having the information necessary to cause the acoustical members to perform over time as necessary to play the desired musical composition, and (h) a software program configured to receive the music input signal and the rotation output signal and use these to generate a control signal for the power source that yields the temporal distribution of power necessary to intermittently illuminate the rings of lights as they are passing through the fields of view of the photosensors so that the resulting photosensor output signals will cause the strikers to create with the acoustic members those sounds required to play the desired musical composition.

A first variant of this embodiment is achieved by configuring its lights so that they are of differing colors and variable intensity, and to then further configure its software program so as to vary the illumination intensity or colors of these lights so as to provide more precise control of the photosensor output signals and the resulting quality that can be achieved in any musical composition that is played by the apparatus.

By temporarily deactivating the present invention's photosensors through a "mute" button or other means, and thus deactivating their programmed action to cause the strikers to create with the acoustic members those sounds required to play the desired musical composition, the present invention can be converted into an apparatus whose intermittently illuminated lights can help a student to learn how to play a musical instrument of the type that includes a plurality of acoustical members that must be struck, plucked or actuated in the proper manner and at the proper times in order to play a desired musical composition.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1A:
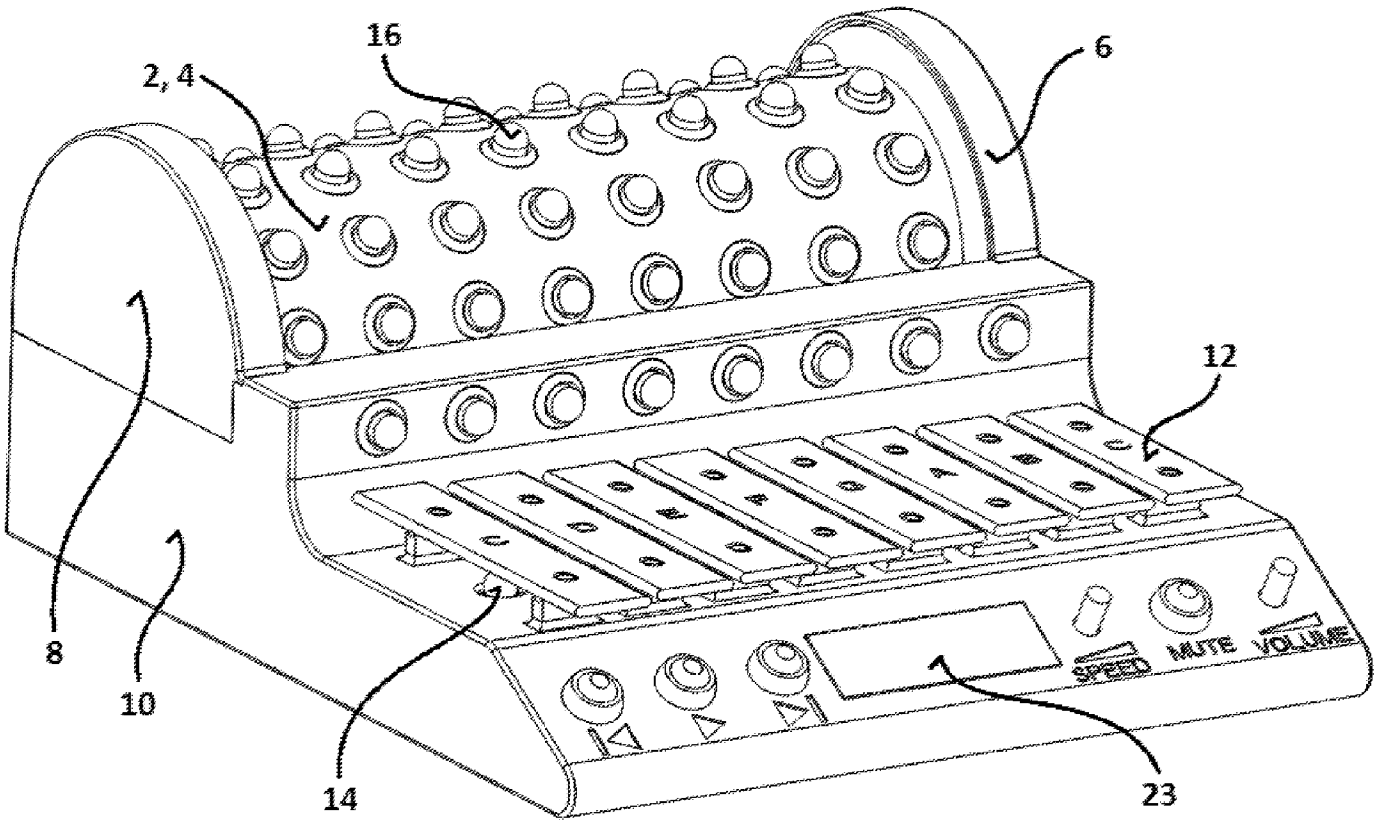
FIG. 1A is a perspective, frontal, exterior view of an 8-note, C-major diatonic scale version of a music box embodiment of the present invention.
Figure 1B:
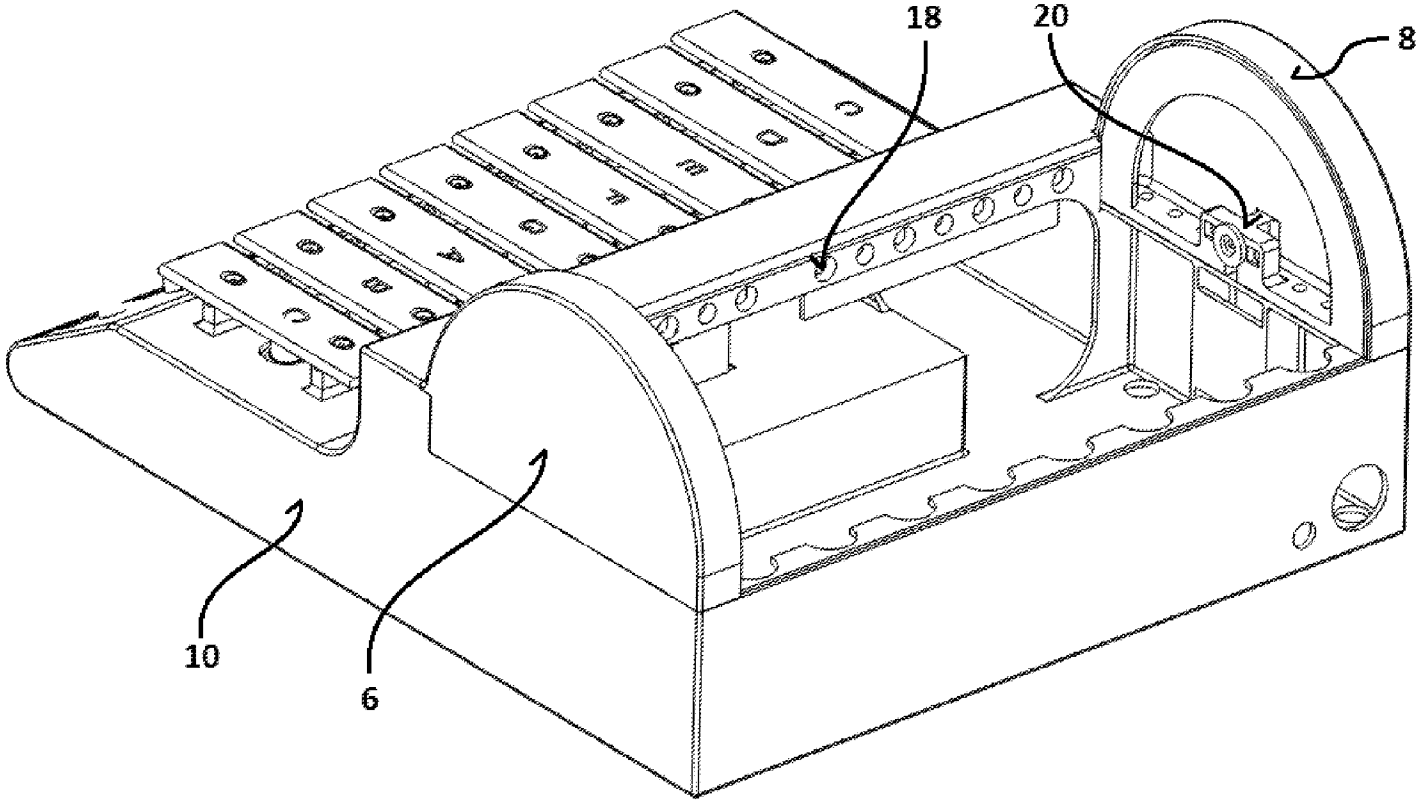
FIG. 1B is a perspective, rear, exterior view of the embodiment shown in FIG. 1A, but with its rotatable cylinder removed.
Figure 1C:
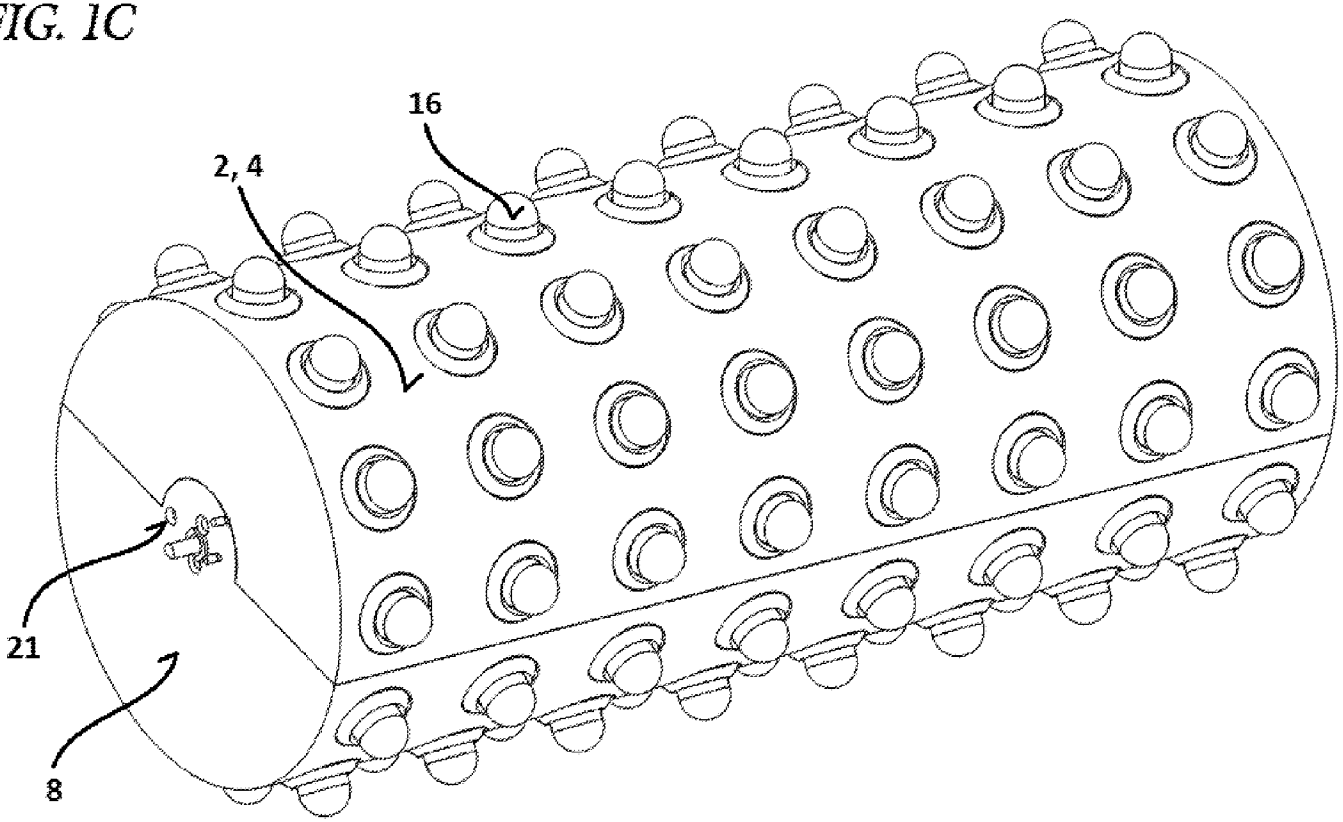
FIG. 1C is a perspective, exterior view of the rotatable cylinder that is used in the embodiment shown in FIG. 1A.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As previously noted, traditional music boxes are limited by the physical size of the cylinder that such boxes use to convey the music which they are to play. This limitation makes it possible for a traditional music box to usually only play a fraction of a standard length, musical composition.

The present invention overcomes this limitation and makes it possible for an automated musical instrument, of the type that creates music by way of percussion and/or vibration effects, to play entire musical compositions of any desired length or temporal duration. This is accomplished by the present invention using spaced-apart, rings of intermittently illuminatable lights on a rotating cylinder (instead of strategically placed pegs or physical extrusions on a cylinder's outer surface) and whose illumination patterns can be programmed to change on each revolution of the cylinder and an array of photosensors to identify when certain of these lights are illuminated and, in response to such an illumination signal, then causing the strikers of the musical instrument to actuate its acoustical members to play a musical composition of any desired duration.

Knowledge of the sounds created by such an instrument's acoustical members and how and when each of these must be struck or plucked to play a certain musical composition enables one to begin to write a musical composition, computer program that helps a programmable controller or central processing unit to control the temporal supply of power that intermittently on each revolution of the cylinder illuminates the various lights and thereby generates the photosensor signals that determine when and how the various acoustical members are sounded. Also inputted into this programmable controller is the output signal from a rotation sensor which monitors the rotation rate or angular location of the instrument's cylinder and its rings of lights so these rotating lights can be properly timed to illuminate when they are rotating and passing through the field of view of the photosensors that are associated with specific strikers that need to act to create the properly timed and modulated sounds from the instrument's acoustical members.

Thus, this instrument's controller can be pre-programmed to update the intermittent illumination of its lights for each revolution that its cylinder makes in an infinitely varying and continuous manner until any desired musical composition is reproduced acoustically. This capability effectively revolutionizes the way in which music boxes and other automated and interactive musical instruments can be played. Additionally, in a dark room, the present invention, with its rotating and intermittently illuminated lights, puts on a very nice light show with musical accompaniment.

Shown in FIG. 1 is a perspective, exterior view of an 8-note, C-major diatonic scale version of a music box embodiment of the present invention. It is seen to include: (a) a circular cylinder 2 which has an outer surface 4 with proximal 6 and distal 8 ends and an axial centerline that extends between these ends, see FIG. 1C, (b) a frame 10 that is configured to mount the cylinder so that it rotates about its axial centerline, (c) eight acoustical members 12 (e.g., bells, metal or wooden bars, strings, pluckable pins or other) that are mounted to the frame, see also FIG. 1B, and (d) eight strikers 14 (e.g., actuators, solenoids, motors, or other) that are also mounted to the frame, with each of these being associated with one of the acoustic members and configured so as to intermittently cause sound to be created from its associated acoustical member when the striker receives an appropriate input signal.

This version of the present invention also includes (e) eight rings of individual, spaced-apart lights 16 (e.g., LEDs, incandescent, or other) that are located on the cylinder's outer surface and at specified, spaced-apart, axial distance from the cylinder's proximal end, (f) eight photosensors 18 (e.g., light dependent resistors, photodiodes, photovoltaics, or other) that are mounted to the frame so that the field of view of each of these aligns with the axial location on the cylinder about which one of the rings of lights is rotating, and with each of these photosensors being configured to provide a light output signal, when an intermittently illuminated light rotates through its field of view, that is sufficient to cause the striker with which the photosensor is associated to be actuated so that it brings forth from its associated acoustical member the properly timed and modulated sound that is called for by the musical composition which the musical instrument is supposed to be playing, (g) a rotation sensor 20 (e.g., rotary encoder, magnetic encoder, Hall-effect sensor, or other) that is mounted on the frame and configured to detect the rotational position relative to the frame of the cylinder's distal end upon which is mounted the moving portion 21 of the sensor (e.g., magnet, magnetic encoder, indicator, or other), and to consequently generate a proportional rotational-position signal that can be used to control the operation of the apparatus, and (h) various control knobs and a digital readout means 23 on the front of the frame that enable a user to control the audio volume, the speed of the cylinder and therefore the tempo of the music, and the play/pause, etc. functions of the instrument—additionally, a "mute" button on the frame enables a no-striker mode of operation or a "learning mode" in which a user can observe the intermittently illuminated and rotating lights to better learn how to strike, pluck or actuate the instrument's acoustic members in the proper manner and at the proper times in order to play a desired musical composition.

Figure 1D:
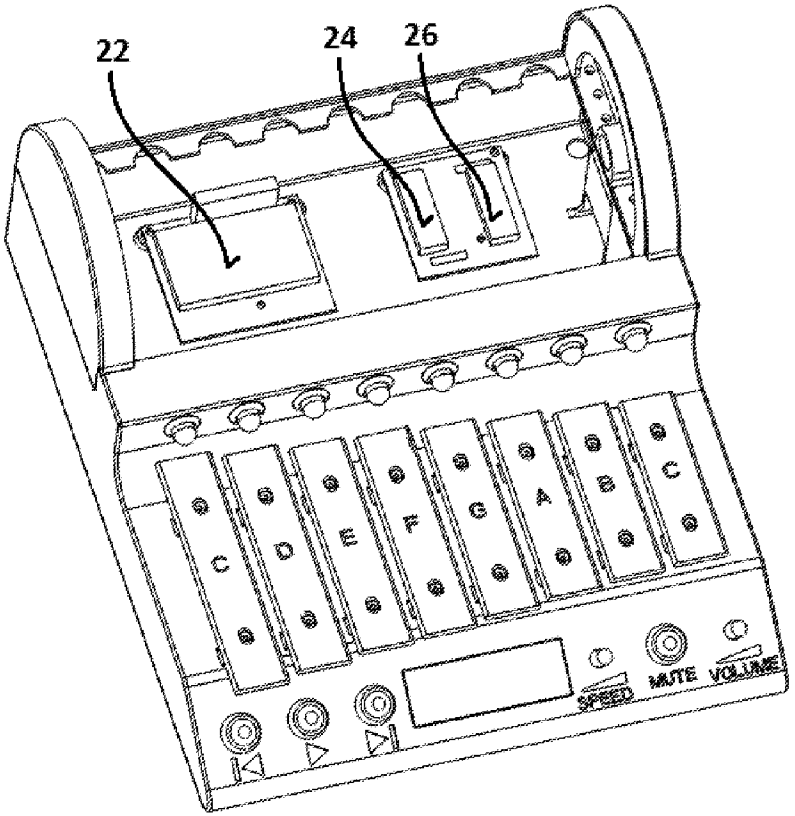
FIG. 1D is a perspective, top, exterior view of the embodiment shown in FIG. 1A, but with its rotatable cylinder removed.

Shown in FIG. 1D is a perspective view of the interior region of the music box embodiment. It is seen to include the control system for the lighting system of the apparatus. It includes: (i) a lightening power regulator 22 that coverts or adjusts the incoming line voltage or battery voltage which powers the apparatus to supply the power necessary to intermittently illuminate the rings of lights and play a desired musical composition, (j) a means for inputting and storing in the apparatus a music input signal or data with the information necessary to cause the acoustical members to perform as required to play a desired musical composition. There are many ways that this music input means can be arranged and operated. For example, it could consist of a memory device 24 which contains an acoustic member software program that identifies for any form of inputted music the timing and order, etc. in which the various acoustical members are to be actuated to play one or more desired musical compositions, and (k) a programmable controller or central processing unit (CPU) 26 that is configured to utilize it operating software program, which takes as its the music input signal and the rotational-position output signal, and generates a signal to control or regulate the operation of the lighting power source so that the temporal distribution of power necessary to illuminate the rings of lights passing on each revolution of the cylinder through the fields of view of the photosensors is such that the resulting signal will cause the strikers to create from their associated acoustic members the sounds required to play a desired musical composition.

Figure 2:
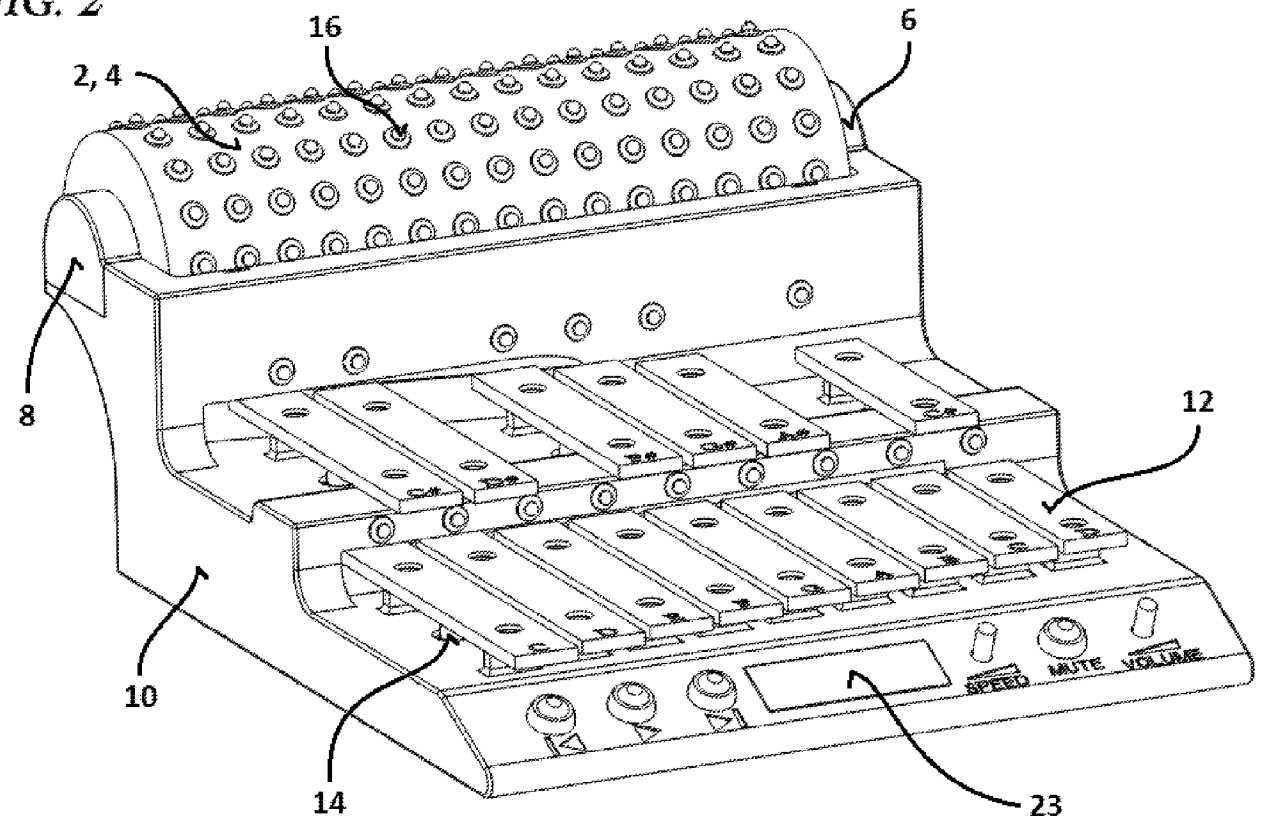
FIG. 2 is a perspective, exterior view of a 15-note, chromatic scale version of a music box embodiment of the present invention.

Although FIGS. 1A-1D show an 8-note, C-major diatonic scale version of a music box embodiment of the present invention, it should be noted that many other versions of similar music boxes can be constructed using the general concepts that have been disclosed above. For example, FIG. 2 shows a perspective, exterior view of an 15-note, chromatic scale version of a similar music box.

Figure 3:
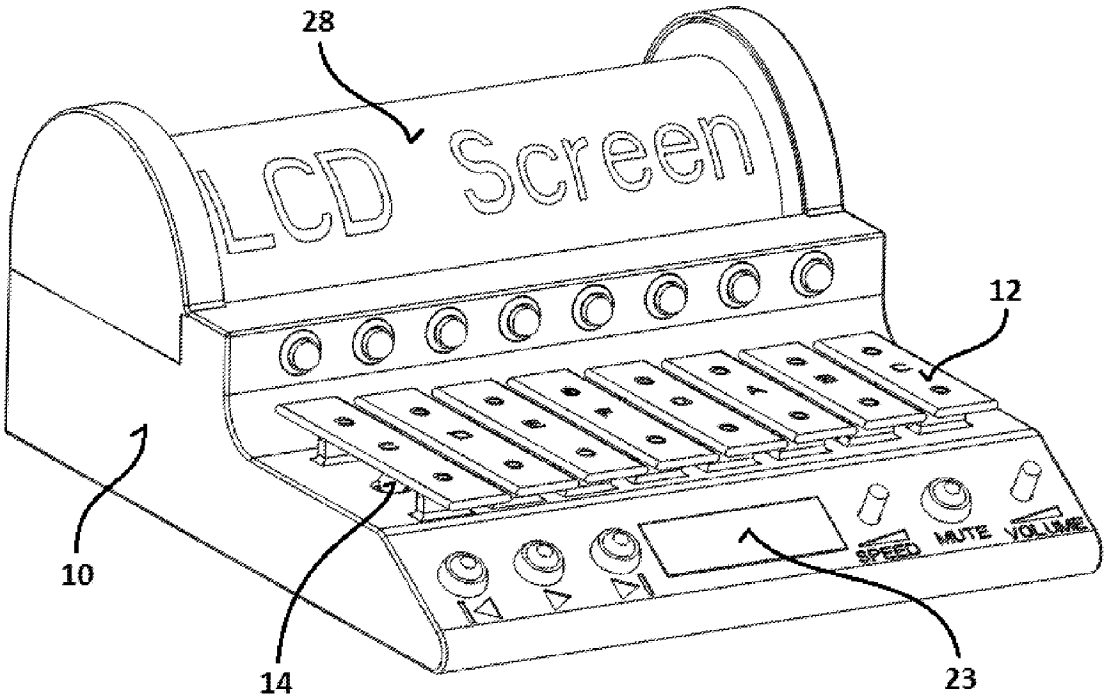
FIG. 3 is a perspective, exterior view of the embodiment shown in FIG. 1A, but with a fixed, non-planar LCD screen wrapped around the cylinder or barrel in a manner that it replaces the placement and function of the mounted rings of lights.
Figure 4:
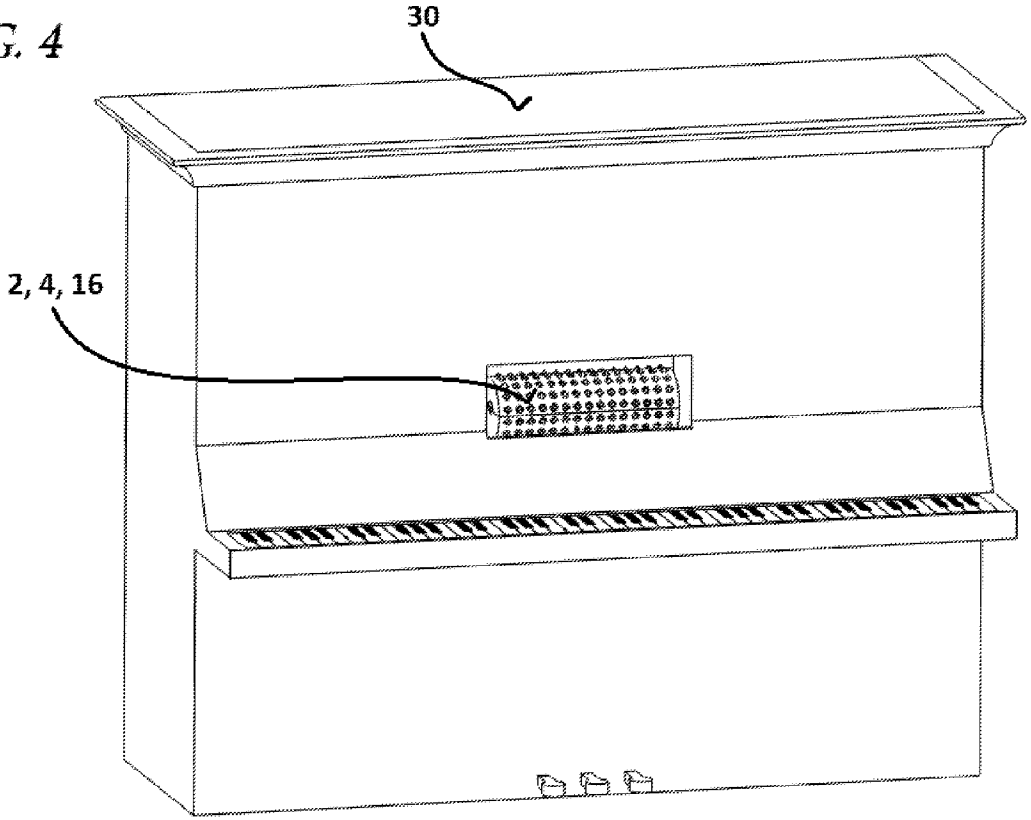
FIG. 4 is a perspective, exterior view of an upright piano embodiment of the present invention.
Figure 5:
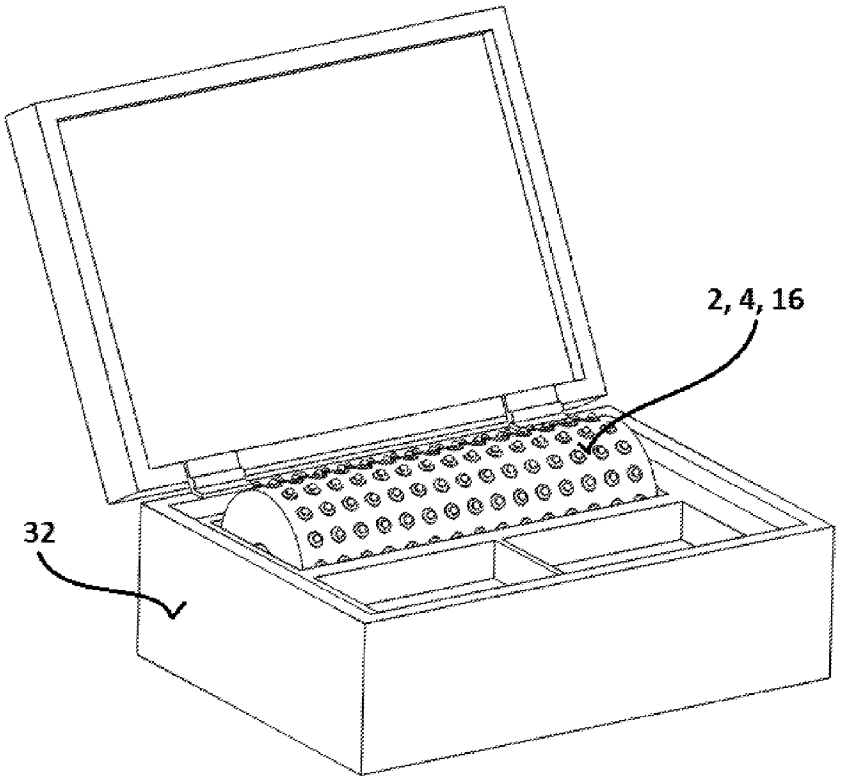
FIG. 5 is a perspective, exterior view of a classic table-top embodiment of the present invention.
Figure 6:
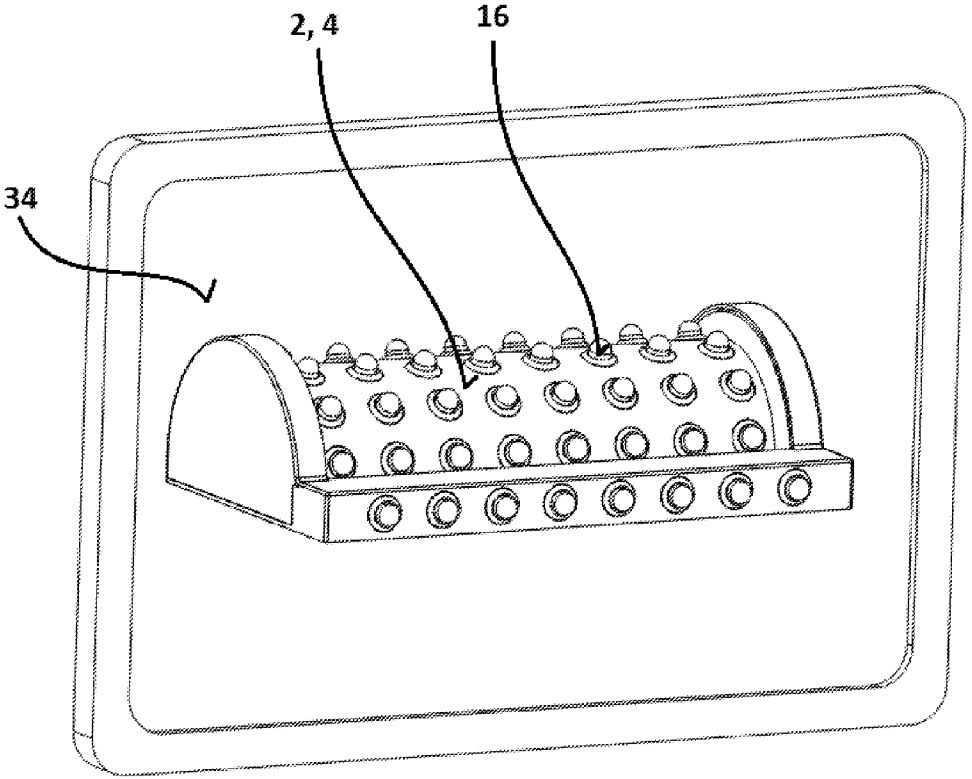
FIG. 6 is a perspective, exterior view of the spaced-apart, rings of intermittently illuminatable lights on a rotating cylinder used to control their associated acoustic members digitally while animated on a computer, hand held tablet, or cell phone screen.

A further example, FIG. 3 shows a perspective, exterior view of the music box embodiment that utilizes an LCD screen 28 wrapped around the cylinder or barrel in such a manner that the LCD screen replaces the placement and function of the aforementioned cylinder mounted rings of lights and rotation sensor by presenting an image of such a rotating cylinder with intermittently, illuminated lights. Yet another example, FIG. 4 shows a perspective, exterior view of a piano embodiment 30 that has installed spaced-apart, rings of intermittently, illuminatable lights on a rotating cylinder used to control their associated piano acoustic members required to play a desired musical composition. A still further example, FIG. 5 shows a perspective, exterior view of a classic tabletop, music box embodiment 32 that has installed spaced-apart, rings of intermittently, illuminatable lights on a rotating cylinder used to control their associated music box acoustic members required to play a desired musical composition. A last example, FIG. 6 shows a perspective, exterior view of the spaced-apart, rings of intermittently, illuminatable lights on a rotating cylinder used to control their associated acoustic members digitally while animated on a computer, hand held tablet or cell phone screen 34.

Figure 7:
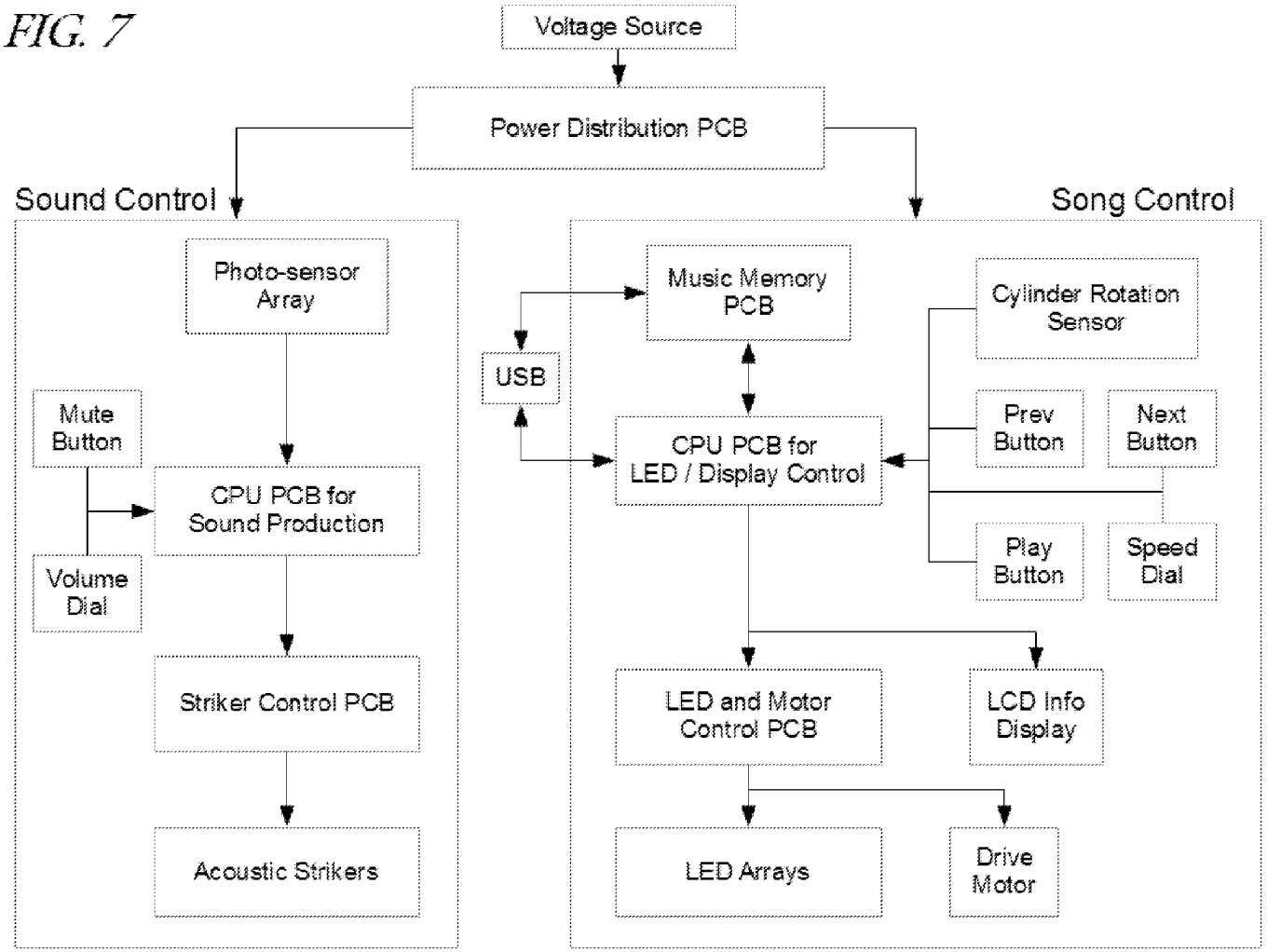
FIG. 7 shows a schematic diagram for the electrical circuitry that would be suitable for the music box embodiments shown in the prior FIGS.

The engineering, testing and construction of the initial prototypes of this apparatus proceeded in a standard manner. The electronic circuitry for the apparatus was designed and first assembled on a breadboard form, then the design was documented in CAD/CAM software with full schematics, printed circuit boards were manufactured, and then the necessary component parts were soldered onto the boards and this whole electronic portion was assembled and put into a final packaged form. FIG. 7 shows a schematic diagram for the type of electrical circuitry that would be suitable for use in the various embodiments of the present invention that are disclosed herein. Since there are many electrical circuit configurations that are capable of achieving the desired operation of the present invention, this schematic should be considered in no way to limit the scope of the present invention. For example, it could be that a commercial version of this electrical circuitry of the present invention would involve the use of flexible printed circuit boards with appropriate LEDS situated or installed on them to form the necessary rings of lights.

All the initial software programming for the apparatus was written by the inventor in a C++ Derivative Programming Language with support from libraries created in the public space. Ultimately, it is anticipated that the software for a commercial version of the apparatus would be coded in C++ and be proprietary in nature.

The design, selection and assembly of the mechanical components of this apparatus encountered only minor problems and is considered to be within the knowledge realm of an experienced mechanical engineer and will therefore not be discussed further herein. It can be noted that it was possible to construct most of the initial mechanical parts by having them 3D printed. However, it is anticipated that commercial production of the present invention's various mechanical components will likely require the fabrication of injection molded parts or the use of similar plastic manufacturing techniques.

While the above discussion has pertained to a music box version of the present invention, it should be recognized that the present invention is capable of many other versions. For example, a second version or variant of the present invention could be as a teaching tool for a student who follows the illumination of the apparatus' lights with the sound muted and tries to strike the appropriate keys on a xylophone or piano in response to the temporally varying illumination of the lights. In this version, the key components of the present invention are reduced to only a circular cylinder on which are mounted rings of lights, a rotation sensor, a lightening power regulator, a means for inputting and storing in the apparatus a music input signal, and a programmable controller which has a software program that is configured to receive the music input signal and the rotation sensor's output signal and use them to generate a signal to control the temporal distribution of power necessary to illuminate the rings of lights so that this illumination is representative of the music which the student is to try to create.

A third version of the present invention is that in which the apparatus is modified so that it takes as its musical input in the form of downloadable songs and utilizes a musical adapter software program to convert such songs to the lighting instructions that are needed to have, for example, a piano play such songs so as to provide ambient room music and wherein the piano's strings replace the acoustical members of the music box version described above. In this version, the key components of the present invention are a circular cylinder on which are mounted rings of lights, a rotation sensor, photosensors and associated means for actuating a piano's strikers, a lightening power regulator, a means for inputting (e.g., a MIDI plug) and storing in the apparatus a music input signal, the musical adapter software program and a programmable controller that is configured to receive the musical adapter software program's output signal and use it to generate a signal to control the temporal distribution of power necessary to illuminate the rings of lights so that this illumination causes the piano to play the desired, inputted music.

Another version of the present invention would be that in which the apparatus is modified so as to use colored lighting (e.g., colored LEDs) to both enhance the quality of the light show provided by the present invention while also using these differing colors as to convey different musical instructions, such as tempo, loudness, rests, double strikes, off beat patterns, etc., to the apparatus' acoustical members. Alternatively, the present invention can be programmed so as to vary the brightness of its lights so as to convey musical instructions for loudness, etc. Additionally, it should be noted that, while we have above only discussed the present invention as communicating musical instructions, the present invention can convey other forms of information.

Yet another version of the present invention would be that in which the apparatus is modified so as to use a fixed location flexible, non-planar LCD screen wrapped around the cylinder or barrel in a manner that it replaces the placement and function of the aforementioned cylinder mounted rings of lights and rotation sensor. Such a configuration would allow an animation to flow around the cylinder or barrel on the LCD screen such that its properly located illuminations would pass through the fields of view of the photosensors in such a way that the resulting signal will cause the strikers to create from their associated acoustic members the sounds required to play a desired musical composition.

A still further version of the present invention would be that of it in a digital form—i.e., a LED ladened cylinder or barrel transmitting musical (or other) information as if it were all just an animation on a video screen that serves the same function of the photosensors in generating output signals that can be used to control a musical instrument or other device. With such lighted barrel animation being shown on the screen of a smart phone or computer device, one could just stick the smart phone into a standalone toy that is configured with a reader that can accept its musical or other informative inputs from a smart phone's screen. Alternatively, a software program or application could be written for such a smart phone or device that would convert the information contained in the lighted barrel animation on the device's screen into a format that would allow this information to be conveyed by other means (e.g., bluetooth or USB connectivity). Since it is well know in the art as to how to write such software programs, no further discussion will be provided herein on how to accomplish such a task.

While the above discussion has so far focused on apparatuses for implementing the present invention, it should also be understood that the present invention can also be described as a method for converting musical or other data information signals into instructions that can cause a musical instrument or other device to take a desired action in response to such inputted information. In general, the key steps required to implement such methods include: (1) inputting and storing a musical or other information input signal, (2) mounting rings of lights on the outer surface of a rotatable circular cylinder, (3) utilizing photosensors aligned so that their fields of view are focused so as to capture the temporally varying illumination that comes from each of the rings of lights, (4) utilizing a rotation sensor to continuously monitor the rotational location of the cylinder's outer surface and its rings of lights, and (5) utilizing a programmable controller that is configured to receive the information input signal and the rotation sensor's output signal and use them to generate a temporally varying signal to control the distribution of power necessary to illuminate the rings of lights so that this temporally varying illumination pattern is representative of the information inputted and sufficient to cause an external device or instrument (e.g., a music box with strikers and acoustical members) to perform in a desired manner (e.g., play a desired musical composition) in response to the inputted information signal.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that are set forth in the claims to the invention.

I claim:

1. An apparatus that allows one to control the operation of a musical instrument of the type that includes a plurality of acoustical members and strikers, wherein each of these strikers is configured to actuate the creation of sound from one of the acoustical members, said apparatus comprising:

a rotatably mounted, circular cylinder having an outer surface with an axial centerline that extends between said ends, a plurality of rings of individual, spaced-apart lights that are located on the outer surface of said cylinder, a plurality of photosensors, each of which has a field of view and a configuration adapted to orient the field of view of said photosensor towards a point through which passes the path of one of said rings of spaced-apart lights as said cylinder is rotated about its axial centerline and with said photosensor configuration further adapted to yield a photosensor output signal that is capable of controlling the temporal operation of one of said strikers, a rotation sensor having a configuration adapted to continuously detect the rotational position of the outer surface of said cylinder and to generate an rotation output signal that is indicative of the rotational position of the outer surface of said cylinder, a power source having a configuration adapted to supply the power necessary to illuminate said rings of spaced-apart lights, a programmable controller with a cooperating memory storage element, a means for inputting into said memory storage element of said programmable controller a music input signal having the information necessary to cause said acoustical members to perform over time as necessary to play a desired musical composition, and a software program having a configuration adapted to allow said program to be stored in said memory storage element and operate said controller so as to receive said music input signal and said rotation output signal and use these to generate a control signal for said power source that yields the temporal distribution of power necessary to intermittently illuminate said rings of lights as they are passing through the fields of view of said photosensors so that the resulting photosensor output signals will cause said strikers to create with said acoustic members those sounds required to play said desired musical composition.

2. The apparatus as recited in claim 1, wherein:

said means for inputting is a MIDI connector.

3. The apparatus as recited in claim 1, wherein:

said lights are of varying colors, and said configuration of said software program is further adapted to control the illumination of the colors of said lights so as to provide further control of said photosensor output signals and the operation of said strikers and acoustic members in playing said desired musical composition.

4. The apparatus as recited in claim 2, wherein:

said lights are of varying colors, and said configuration of said software program is further adapted to control the illumination of the colors of said lights so as to provide further control of said photosensor output signals and the operation of said strikers and acoustic members in playing said desired musical composition.

5. The apparatus as recited in claim 1, wherein:

said lights are of varying intensity, and said configuration of said software program is further adapted to control the illumination intensity of said lights so as to provide further control of said photosensor output signals and the operation of said strikers and acoustic members in playing said desired musical composition.

6. The apparatus as recited in claim 2, wherein:

said lights are of varying intensity, and said configuration of said software program is further adapted to control the illumination intensity of said lights so as to provide further control of said photosensor output signals and the operation of said strikers and acoustic members in playing said desired musical composition.

7. The apparatus as recited in claim 3, wherein:

said lights are of varying intensity, and said configuration of said software program is further adapted to control the illumination intensity of said lights so as to provide further control of said photosensor output signals and the operation of said strikers and acoustic members in playing said desired musical composition.

8. The apparatus as recited in claim 4, wherein:

said lights are of varying intensity, and said configuration of said software program is further adapted to control the illumination intensity of said lights so as to provide further control of said photosensor output signals and the operation of said strikers and acoustic members in playing said desired musical composition.

9. An apparatus that helps a student to learn how to play a musical instrument of the type that includes a plurality of acoustical members that must be struck, plucked or actuated in the proper manner and at the proper times in order to play a desired musical composition, said apparatus comprising:

a rotatably mounted, circular cylinder having an outer surface with an axial centerline that extends between said ends, a plurality of rings of individual, spaced-apart lights that are located on the outer surface of said cylinder and situated so that said rings of lights are in the field of view of said student when said student is attempting to play said desired musical composition, a rotation sensor having a configuration adapted to continuously detect the rotational position of the outer surface of said cylinder and to generate an rotation output signal that is indicative of said rotational position of the outer surface of said cylinder, a power source having a configuration adapted to supply the power necessary to illuminate said rings of spaced-apart lights, a programmable controller with a memory storage element, a means for inputting into said memory storage element of said programmable controller a music input signal having the information necessary to cause said acoustical members to perform over time as necessary to play said desired musical composition, and a software program having a configuration adapted to receive said music input signal and said rotation output signal and to use these to generate a control signal for said power source that yields the temporal distribution of power necessary to intermittently illuminate said rings of lights in a manner that is instructive to said student as to how and when to actuate said acoustical members so as to play said desired musical composition.

10. The apparatus as recited in claim 9, wherein:

said means for inputting is a MIDI connector.

11. The apparatus as recited in claim 9, wherein:

said lights are of varying colors, and said configuration of said software program is further adapted to control the illumination of the colors of said lights so as to provide further instruction to said student as to how and when to actuate said acoustical members so as to play said desired musical composition.

12. The apparatus as recited in claim 10, wherein:

said lights are of varying colors, and said configuration of said software program is further adapted to control the illumination of the colors of said lights so as to provide further instruction to said student as to how and when to actuate said acoustical members so as to play said desired musical composition.

13. The apparatus as recited in claim 9, wherein:

said lights are of varying intensity, and said configuration of said software program is further adapted to control the illumination intensity of said lights so as to provide further instruction to said student as to how and when to actuate said acoustical members so as to play said desired musical composition.

14. The apparatus as recited in claim 10, wherein:

said lights are of varying intensity, and said configuration of said software program is further adapted to control the illumination intensity of said lights so as to provide further instruction to said student as to how and when to actuate said acoustical members so as to play said desired musical composition.

15. The apparatus as recited in claim 11, wherein:

said lights are of varying intensity, and said configuration of said software program is further adapted to control the illumination intensity of said lights so as to provide further instruction to said student as to how and when to actuate said acoustical members so as to play said desired musical composition.

16. The apparatus as recited in claim 12, wherein:

said lights are of varying intensity, and said configuration of said software program is further adapted to control the illumination intensity of said lights so as to provide further instruction to said student as to how and when to actuate said acoustical members so as to play said desired musical composition.

17. An apparatus that allows one to control the operation of a musical instrument of the type that includes a plurality of acoustical members and strikers, wherein each of said strikers is configured to actuate the creation of sound from at least one of said acoustical members, said apparatus comprising:

a visual display means for displaying the image of a rotatably mounted, circular cylinder having an outer surface with an axial centerline that extends between said ends, and, located on the outer surface of said cylinder, a plurality of rings of individual, spaced-apart, intermittently, illuminatable lights, a plurality of photosensors, each of which has a field of view and a configuration adapted to orient the field of view of said photosensor towards a point through which passes the path of the image of one of said rings of spaced-apart lights as said cylinder is rotated about said axial centerline and with said photosensor configuration further adapted to yield a photosensor output signal that is capable of controlling the temporal operation of one of said strikers, a rotation sensor having a configuration adapted to continuously detect the rotational position of the image of said outer surface of said cylinder and to generate an rotation output signal that is indicative of the rotational position of the outer surface of said cylinder, a programmable controller with a cooperating memory storage element, a means for inputting into said memory storage element of said programmable controller a music input signal having the information necessary to cause said acoustical members to perform over time as necessary to play a desired musical composition, and a software program having a configuration adapted to allow said program to be stored in said memory storage element and operate said controller so as to receive said music input signal and said rotation output signal and use these to generate a control signal for said visual display means that yields said image with temporally varying illumination of said rings of lights as they are passing through the fields of view of said photosensors so that the resulting photosensor output signals will cause said strikers to create with said acoustic members those sounds required to play said desired musical composition.

18. The apparatus as recited in claim 17, wherein said images of said lights are of varying colors, and said configuration of said software program is further adapted to control the illumination of the colors of said lights so as to provide further control of said photosensor output signals and the operation of said strikers and acoustic members in playing said desired musical composition.

19. The apparatus as recited in claim 17, wherein said images of said lights are of varying intensity, and said configuration of said software program is further adapted to control the illumination intensity of said lights so as to provide further control of said photosensor output signals and the operation of said strikers and acoustic members in playing said desired musical composition.

20. The apparatus as recited in claim 18, wherein said images of said lights are of varying intensity, and said configuration of said software program is further adapted to control the illumination intensity of said lights so as to provide further control of said photosensor output signals and the operation of said strikers and acoustic members in playing said desired musical composition.

* * * * *